United States Patent [19]

Dodge

[11] Patent Number: 4,744,347

[45] Date of Patent: May 17, 1988

[54] ARCHERY GAME TRACKING DEVICE

[76] Inventor: Paul A. Dodge, Route 3, Menomonie, Wis. 54751

[21] Appl. No.: 910,132

[22] Filed: Sep. 22, 1986

[51] Int. Cl.[4] ..... F41B 5/00; A63B 65/02

[52] U.S. Cl. ..... 124/86; 273/416

[58] Field of Search ..... 273/416, 418, 419, 420; 43/6

[56] References Cited

U.S. PATENT DOCUMENTS

| | | | |
|---|---|---|---|
| 2,796,691 | 6/1957 | Norris | 43/6 |
| 4,252,325 | 2/1981 | Weems et al. | 273/416 |
| 4,651,999 | 3/1987 | Sturm | 273/416 |

OTHER PUBLICATIONS

Packaging for The Game Tracker professional tracking unit, The Game Tracker, Inc., G-5265 W. Pierson Rd., Flusing, MI 48433.

*Primary Examiner*—Richard C. Pinkham
*Assistant Examiner*—Benjamin Layno
*Attorney, Agent, or Firm*—Burd, Bartz & Gutenkauf

[57] ABSTRACT

An archery game tracking device for tracking a game animal struck by an arrow upon subsequent movement by the animal through brush or forest. The device includes a dart that is releasably mounted to the arrow shaft and is fixed to a tracking line. A tracking line supply is connected to the bow. Upon impact of the arrow with a game animal, the dart penetrates the animal. If the animal dislodges the arrow or if the arrow passes through the animal, the dart will automatically separate from the arrow and will remain fixed to the animal and fixed to the tracking line. The hunter will still be able to track the fallen animal when it stops.

20 Claims, 1 Drawing Sheet

ARCHERY GAME TRACKING DEVICE

BACKGROUND OF THE INVENTION

In the field of bow and arrow hunting, oftentimes a fatally wounded animal will travel a distance before falling. The animal must be tracked by the hunter, which can be difficult in forest or heavy brush. Game tracking devices are often used. A common type of device has a long tracking line fixed to the arrow. A supply of the line is stored near the bow and is played out upon release of the arrow and subsequent flight of the animal with the arrow lodged in it. The first response of the animal upon being struck by an arrow is usually an attempt to dislodge it, often successfully, whereby the tracking device is rendered ineffective. Sometimes the arrow passes through the animal and the tracking line is quickly broken upon movement of the animal.

SUMMARY OF THE INVENTION

The invention relates to an archery game tracking device for use by an archer to track a wounded game animal struck by an arrow. The device includes a dart which is releasably mounted on a base, which is fixed to the hunting arrow near the tip or head thereof. Upon initial penetration of the arrowhead in the animal, the dart penetrates a short distance. Upon further penetration of the arrow into the animal, the dart is released from the arrow shaft and remains lodged in the animal independent of the arrow. If the arrow is subsequently dislodged from the animal, the dart remains. A tracking line is fixed to the dart and is played out from a tracking line supply upon flight of the arrow and subsequent movement of the animal. The hunter follows the tracking line to the animal even though the arrow has been dislodged or has completely penetrated a portion of the animal and exited the opposite side.

IN THE DRAWINGS

DESCRIPTION OF PREFERRED EMBODIMENTS

Figure 1:
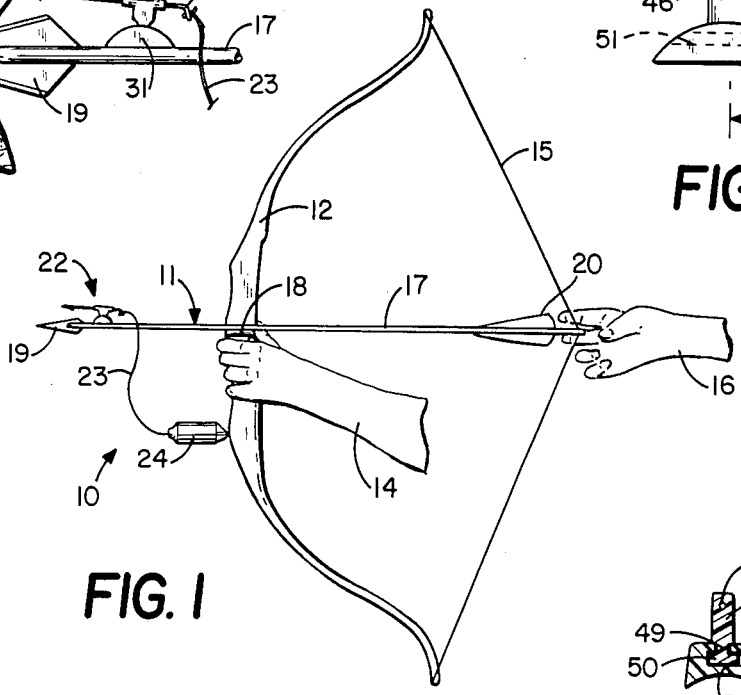
FIG. 1 is a side elevational view of a bow and drawn arrow having an archery game tracking device according to the invention.

Referring to the drawings, there is shown in FIG. 1 an archery game tracking device indicated generally at 10 installed with respect to an arrow 11 and a bow 12 held in the left hand 14 of an archer with the right hand 16 drawing the bow string 15 preparatory to discharge of the arrow. The arrow 11 includes a shaft 17 resting on arrow rest 18 fixed to the belly of bow 12. The forward end of arrow 11 has the usual multi-bladed head or tip 19. The rearward end of arrow 11 carries the conventional nock and feather assembly 20. The archery game tracking device 10 includes a dart assembly 22 fixed to the arrow shaft 17, a tracking line 23 extending from an end of the dart assembly 22 to a cannister 24 fixed to the bow 12 and carrying a supply of tracking line 23. Archery game tracking device 10 is adapted for tracking a game animal through woods or brush once it has been struck by the arrow 11 discharged from bow 12.

Figure 2:
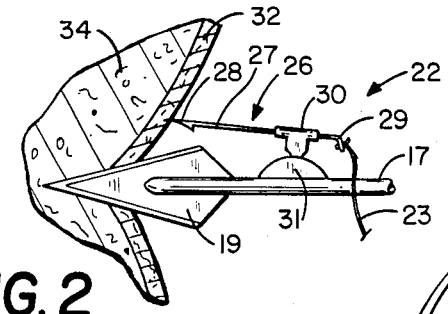
FIG. 2 is an enlarged side elevational view partly in section showing an arrow penetrating the hide of a game animal and having the dart assembly of the archery game tracking device according to the invention installed thereon.

As shown in FIG. 2, the dart assembly 22 is mounted on the arrow shaft 17 just aft of the arrowhead 19. The dart assembly 22 includes an elongate linear dart 26 that is very small in comparison to arrow 11 and has a dart shank 27 and a uni-barb pointed end 28 at the forward end. A mounting eye 29 at the rearward end is fixed to the tracking line 23. A dart holder 30 holds the dart shank 27 at an intermediate location and is releasably connected to a mounting base 31 which is fixed to the arrow shaft 17 by suitable means, such as gluing.

FIG. 2 shows tip 19 of arrow 11 in penetrating relationship to an animal hide after discharge from bow 12, comprised of the relatively tough skin layer 32 adjacent a fat layer 34. As shown, dart shank 27 is mounted on shaft 17 in slightly canted relationship or at a small acute angle with respect to the axis of shaft 17. Dart tip 28 extends forward to the vicinity of the rear of the arrowhead 19 and is spaced a small distance from it according to the height of holder 30 and base 31. Although the arrowhead 19 is extremely sharp, upon penetration of the animal hide, an indentation is momentarily formed as shown. Skin 32 is angularly orientated in the locale where it is approached and penetrated by the barbed tip 28 of dart 26. Together with the canted orientation of dart 26, the force of entry of dart 26 into the angularly inclined skin 32 produces an upward moment or a moment away from the arrow shaft 17 on the dart shank 26 sufficient to dislodge it from the mounting base 31 and secure it in the hide 32 independent of the arrow 11. Dart holder 30 is releasably secured to the mounting base 31 sufficiently to maintain it in place during the flight of the arrow but release it when striking and penetrating the game animal as described. If and when the arrow is successfully dislodged by the animal, the dart 26 remains in place trailing the tracking line 23 which is fed out of the cannister 24.

Figure 3:
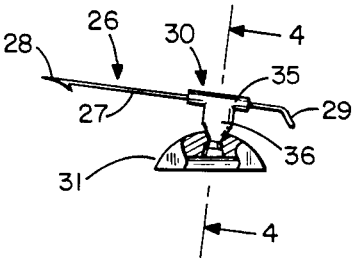
FIG. 3 is an enlarged view of a portion of the archery game tracking device of FIG. 2 partly in section for purposes of illustration.
Figure 3A:
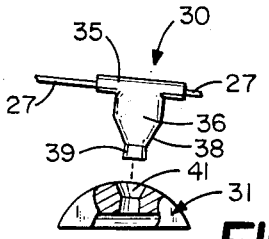
FIG. 3A is a view similar to FIG. 3 showing the dart holder removed from the base of the tracking device.
Figure 4:
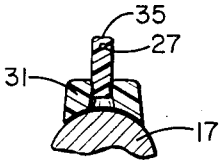
FIG. 4 is a sectional view of the portion of the archery game tracking device of FIG. 3 taken along the line 4—4 thereof.

The particular construction of the dart and dart mount is shown in FIGS. 3, 3A and 4. Dart holder 30 has a tubular collar 35 which embraces a portion of the dart shank 27 toward the rear half thereof. The tubular collar 35 is connected to a body portion 36. A mounting stem includes a conical tapered shoulder 38 extending from body portion 36. Shoulder 38 is tapered inwardly at an angle of approximately 25 degrees. An outwardly tapered or a reverse tapered neck 39 extends from the end of shoulder 38. Neck 39 is outwardly tapered in an angle of approximately 3 degrees. Mounting base 31 has an opening or socket 41 for receipt of the shoulder 38 and neck 39 to releasably secure the dart holder 30 in place with respect to the arrow. The socket 41 is shaped to conform to the stem of the holder 30, having a top opening with converging conical side walls of approximately 25 degrees, and a lower portion with a divergent or reverse draft opening of approximately 3 degrees for accommodating the neck 39 in a snap-type fit. The axis of the socket is slightly rearwardly inclined as shown in FIG. 3. This orientates the dart at a small acute angle relative to the longitudinal axis of the arrow. The base 31 and holder 30 are made of plastic or like material that is slightly compressible to permit a snap-type, in-and-out movement of the holder with respect to the base 31 as shown between FIGS. 3 and 3A. The 25 degree inward taper and 3 degree outward or reverse taper have been found to give a sufficient amount of friction for easy assembly of the dart with respect to the base in the field but provide the proper amount of force to hold the holder with respect to the base until impact with a game animal whereby the neck or post lifts out of the socket for clear separation. The required force to dislodge the holder from the base is sufficient enough to first permit good penetration of the dart into the skin of the animal before release occurs. As shown in FIG. 4, base 31 has a linearly concave bottom to conform to arrow shaft 17.

Figure 5:
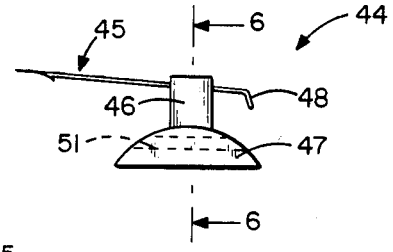
FIG. 5 is a side elevational view of a dart assembly of the archery game tracking device according to another form of the invention.
Figure 6:
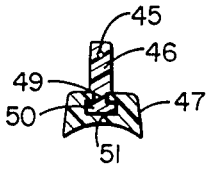
FIG. 6 is a sectional view of the dart assembly of FIG. 5 taken along the line 6—6 thereof.

Other forms of dart assemblies can be employed having a dart that is releasable from a base upon impact with and penetration of an animal. For example, as shown in FIGS. 5 and 6, a dart assembly 44 includes a dart 45 mounted in a holder 46 and having an eye 48 for connection to a game tracking line (not shown). A mounting base 47 releasably holds the dart holder 46. As shown in FIG. 6, the dart holder 46 has a lower neck portion 49 with a wide foot 50. The neck and foot 49, 50 fit in a corresponding opening or slot 51 formed in the base 47. The slot 51 has a narrow upper portion and a widened lower portion to accommodate the neck and foot 49, 50 and prevent dislodgement in an upward direction. The neck and foot 49, 50 are movable in the slot 51 in a longitudinal or rearward direction. When the base 47 is mounted on an arrow which lodges in an animal, the dart 45 penetrates the skin of the animal. Forward movement of the arrow results in the neck and foot 49, 50 sliding rearwardly with respect to the base 47 to a point where it is separated from the base 47 and the corresponding arrow.

Figure 7:
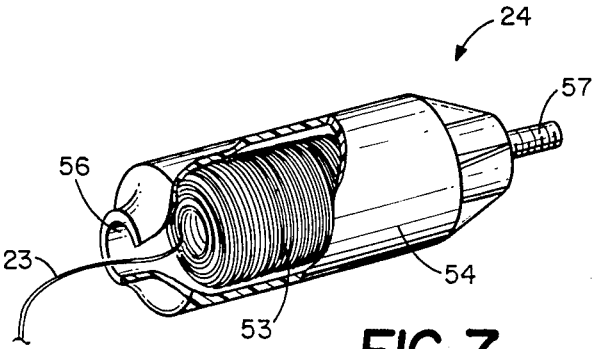
FIG. 7 is a perspective view partly in fragmentation showing the tracking line supply of the archery game tracking device.

FIG. 7 shows the cannister 24 carrying a wound supply 53 of tracking line 23. Cannister 24 includes an outer cylindrical housing 54 containing the supply 53 of tracking line 23 and having an end opening 56 through which the line 23 is trained. The opposite end of the housing 54 carries a threaded bolt 57 which threads into a suitable opening of the type usually provided on the bow 12. Upon discharge of the arrow 11 line is fed out through the opening 56 of the cannister 24. Upon impact of the arrow with the animal, the dart lodges in the animal hide even though the arrow may subsequently be dislodged. The hunter follows the tracking line 23 to the animal. Following use of the device, the supply line 23 can be rewound in the cannister 24 for reuse.

In the use of the tracking device of the invention, normally the cannister 24 will be installed on the bow with the dart assembly 22 located closely adjacent thereto and preferably having a protective covering around it. The dart assembly 22 is not mounted to the base 31 on the arrow until the archer prepares to shoot the arrow. At such time, the dart holder 30 is installed with respect to the base 31 on the arrow 11. Upon discharge of the arrow, the tracking line 23 is fed out from the cannister 24 trailing the dart assembly 22. Upon impact with an animal, the arrow pierces the animal while the dart 27 moves superficially into the animal and then is separated from the arrow. Upon dislodgement of the arrow from the animal, the dart 27 remains so that the animal can be tracked by the hunter by following the tracking line 23.

While there have been shown and described certain embodiments of the invention, it will be apparent that deviations can be had without departing from the scope and spirit of the invention.

The embodiments of the invention in which an exclusive property or privilege is claimed are defined as follows:

1. An archery game tracking device comprising an archery arrow having an arrow shaft and an arrow tip at the forward longitudinal end of the shaft;

an elongate linear dart, small in comparison to the arrow, having a dart tip at the forward end thereof, and a dart shank;

a base connectable to the arrow shaft;

means for releasably connecting the dart to the base with the dart shank spaced a short distance from the arrow shaft in a direction perpendicular to the longitudinal axis of the arrow shaft and pointed generally in the intended path of travel of the arrow, said means connecting the dart to the base with a force sufficient to hold the dart to the base during flight of the arrow and release the dart upon penetration of the dart in an animal hide;

a tracking line having a first end connected to the dart and a second end comprised as a supply of tracking line to be played out upon discharge of the arrow from a bow.

2. The archery game tracking device of claim 1 wherein: a dart holder holding said dart, said dart holder having a stem, said base having a socket, said stem being positionable in said socket in a snap-fit relationship.

3. The archery game tracking device of claim 2 wherein: said dart holder includes a tubular collar engaging a portion of the dart shank, said stem including a downwardly tapered shoulder and an outwardly tapered neck connected to the shoulder, said socket in the base having a shape corresponding to the shoulder and the neck on the dart holder.

4. The archery game tracking device of claim 3 wherein: said shoulder is tapered approximately 25 degrees, said neck being tapered approximately 3 degrees.

5. The archery game tracking device of claim 4 including: a housing, said tracking line supply being contained in said housing, said housing having an opening for feeding out said tracking line, and means on the housing for fixing it to a bow.

6. An archery game tracking device for mounting on an arrow shaft comprising:

a dart having a dart tip and a dart shank;

a base connectable to an arrow shaft;

means for releasable connecting the dart to the base with the dart a short distance from and pointed generally in the intended path of travel of the arrow and positioned with respect to the arrow to point outwardly at a small acute angle relative to the longitudinal axis of the arrow, said means connecting the dart to the base with a force sufficient to hold the dart to the base during flight of the arrow and release the dart upon penetration of the dart in an animal hide;

a tracking line having a first end connected to the dart and a second end comprised as a supply of tracking line to be played out upon discharge of the arrow from a bow.

7. An archery game tracking device comprising:

an arrow having an elongate arrow shaft, an arrowhead, an arrow nock end;

a dart assembly comprising a base fixed to the arrow shaft aft of the arrowhead, a dart having a dart tip and a shank, a dart holder holding the dart by the dart shank, means for releasably connecting the dart holder and the base for release of the dart holder from the base upon impact of the dart, a tracking line having one end fixed to the dart and the other end comprised as a supply of tracking line to be maintained near the bow upon the flight of the arrow.

8. The archery game tracking device of claim 7 wherein: said dart is held by the base and dart holder at a small acute angle relative to the axis of the arrow.

9. The archery game tracking tracking device of claim 8 including: a dart holder holding said dart, said dart holder having a stem, said base having a socket, said stem being positionable in said socket in a snap-fit relationship.

10. The archery game tracking device of claim 9 wherein: said dart holder includes a tubular collar engaging a portion of the dart shank, said stem including a downwardly tapered shoulder and an outwardly tapered neck connected to the shoulder, said socket in the base having a shape corresponding to the shoulder and the neck on the dart holder.

11. The archery game tracking device of claim 10 wherein: said shoulder is tapered approximately 25 degrees, said neck being tapered approximately 3 degrees.

12. The archery game tracking device of claim 11 including: a housing, said tracking line supply being contained in said housing, said housing having an opening for feeding out said tracking line, and means on the housing for fixing it to a bow.

13. The archery game tracking device of claim 7 including: a dart holder holding said dart, said dart holder having a stem, said base having a socket, said stem being positionable in said socket in a snap-fit relationship.

14. The archery game tracking device of claim 13 wherein: said dart holder includes a tubular collar engaging a portion of the dart shank, said stem including a downwardly tapered shoulder and an outwardly tapered neck connected to the shoulder, said socket in the base having a shape corresponding to the shoulder and the neck on the dart holder.

15. The archery game tracking device of claim 14 wherein: said shoulder is tapered approximately 25 degrees, said neck being tapered approximately 3 degrees.

16. The archery game tracking device of claim 7 including: a housing, said tracking line supply being contained in said housing, said housing having an opening for feeding out said tracking line, and means on the housing for fixing it to a bow.

17. The archery game tracking device of claim 16 wherein: said dart shank has an eye at the end opposite the dart tip; said tracking line end fixed to the dart eye.

18. The archery game tracking device of claim 17 wherein: said dart tip has a uni-barb shape.

19. The archery game tracking device of claim 16 wherein: said housing is shaped as a cylindrical canister.

20. The archery game tracking device of claim 7 including: a dart holder holding said dart, said dart holder having a lower neck portion and wide foot, said base having a slot orientated in the intended direction of travel of the arrow and having a narrow upper portion with a widened lower portion to accommodate the neck and foot of the dart holder to prevent dislodgement in an upward direction, but permit movement of the neck and foot in a longitudinal or rearward direction to dislodge the neck and foot of the dart holder from the mounting base upon penetration of the dart into an animal hide and forward movement away from the dart of the arrow and arrow shaft.

* * * * *